US005226296A

United States Patent [19]

Kolvites et al.

[11] Patent Number: 5,226,296

[45] Date of Patent: Jul. 13, 1993

[54] COLD PLATE FOR COOLING BEVERAGES

[76] Inventors: Albert Kolvites, R.R. 3 Box 117A Yeager Rd., Mountaintop, Pa. 18707; Robert J. Cohn, 61 Sterling Ave., Dallas, Pa. 18612

[21] Appl. No.: 885,664

[22] Filed: May 18, 1992

[51] Int. Cl.[5] ..... B67D 5/62; F25D 3/02

[52] U.S. Cl. ..... 62/390; 62/396; 62/460; 62/461; 62/464; 222/146.6

[58] Field of Search ..... 62/390, 396, 398, 399, 62/400, 460, 461, 462, 463, 464; 222/146.6

[56] References Cited

U.S. PATENT DOCUMENTS

| | | | |
|---|---|---|---|
| 1,592,547 | 7/1926 | Vogt | 62/398 |
| 2,244,862 | 6/1941 | Winship | 62/462 X |
| 3,331,536 | 7/1967 | DeLorenzo | 62/464 X |
| 4,042,142 | 8/1977 | Ruano | 62/400 X |
| 4,291,546 | 9/1981 | Rodth | 62/398 |
| 4,651,538 | 3/1987 | Bull et al. | 222/146.6 X |
| 4,678,104 | 7/1987 | Pritchett | 222/146.6 |
| 4,888,961 | 12/1989 | McMichael | 62/464 X |
| 4,958,505 | 9/1990 | Swanson | 222/146.6 X |
| 4,974,426 | 12/1990 | Gomez et al. | 62/464 X |

FOREIGN PATENT DOCUMENTS

| | | | |
|---|---|---|---|
| 33992 | 7/1885 | Fed. Rep. of Germany | 62/461 |
| 140096 | 1/1902 | Fed. Rep. of Germany | 62/464 |
| 540832 | 7/1922 | France | 62/461 |
| 9324 | 4/1909 | United Kingdom | 62/464 |
| 4327 | 2/1911 | United Kingdom | 62/464 |

*Primary Examiner*—Henry A. Bennet
*Assistant Examiner*—Christopher B. Kilner
*Attorney, Agent, or Firm*—Michael Ebert

[57] ABSTRACT

A cold plate for cooling different beverages drawn from supply cylinders, the cold plate being formed by a rectangular base over which is a run-off roof defined by sloping end and side sections. Embedded in the cold plate are cooling coils terminating in input and output terminals that project from the underside of the base, the coil inputs being coupled by upstream lines to respective supply cylinders, the coil outputs being coupled by downstream lines to a soda gun to selectively dispense the beverages. The cold plate is received in the well of a thermally-insulated sink having an open bottom bordered by a rectangular ledge. The base of the cold plate is seated on the ledge in spaced relation to the sides of the well to define a gutter in which there is a water drain. The sink is filled with ice cubes that cover the exposed surfaces of the cold plate and are in heat-exchange relationship with the cooling coils to cool the beverages flowing therethrough. As ice cubes melt, the resultant water runs off the roof and is collected in the gutter from which it is drained, thereby avoiding the formation of a water barrier thermally isolating the ice cubes from the cold plate.

8 Claims, 3 Drawing Sheets

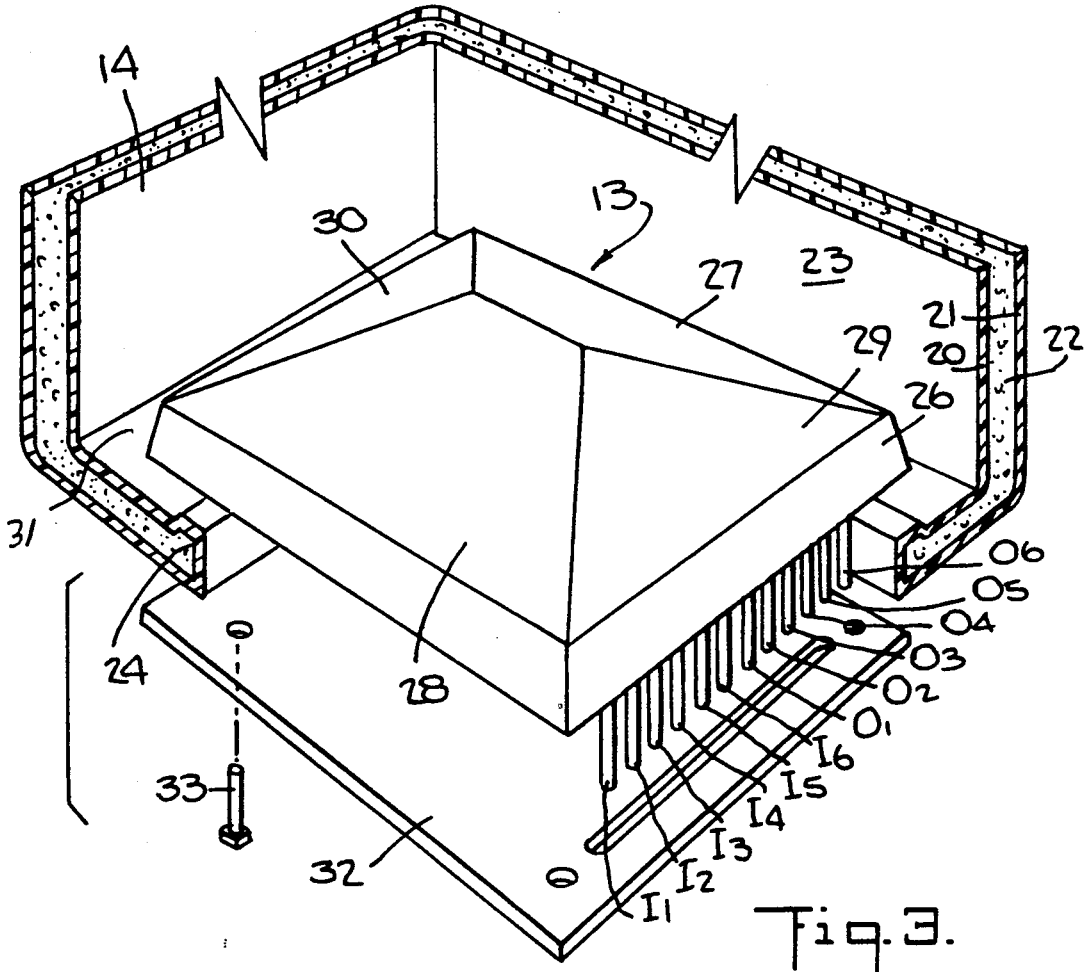
Fig. 3.
Fig. 4.
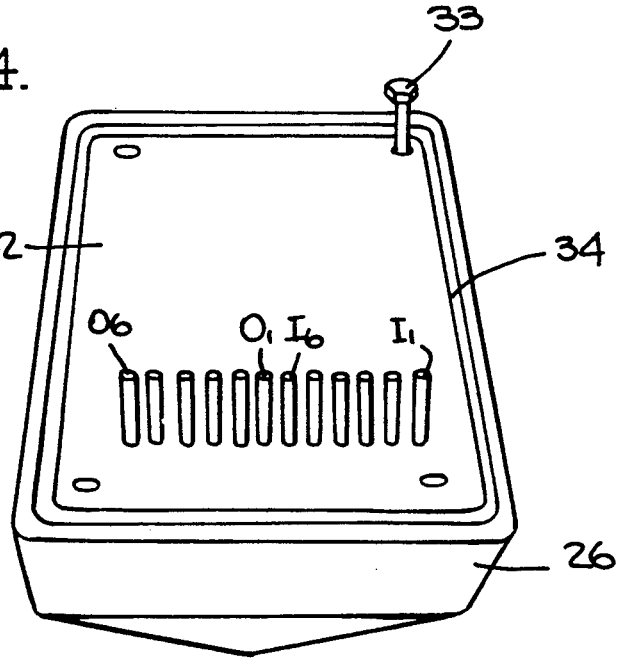

COLD PLATE FOR COOLING BEVERAGES

BACKGROUND OF INVENTION

1. Field of Invention

This invention relates generally to cold plates adapted to cool beverages before they are dispersed, and more particularly to a cold plate installable in the well of a sink in which it is covered with ice cubes, the configuration of the cold plate and the structure of the sink being such that as the ice cubes melt, the resultant water is drained and does not create a thermal barrier between the ice and the cold plate.

2. Status of Prior Art

At an outdoor or other affair in which cold carbonated beverages such as Coca Cola, 7-Up and Ginger Ale are to be served to a large number of guests, or beer, wine and juices, and where electrically-powered refrigerators are not available to cool these beverages, it is now common practice for this purpose to make use of a so-called cold plate placed in a tub and covered with ice cubes.

Embedded in the cold plate, which may be cast of aluminum or other metal having high thermal conductivity are cooling coils whose inputs are coupled by pipes to supply cylinders containing the different beverages, and whose outputs are coupled by pipes to a soda gun or other valved means to selectively dispense the beverages. These beverages are cooled as they pass through the cooling coils which are in heat-exchange relation to the ice cubes.

A pre-mix system is used when the beverages are fully constituted and in condition to be served. Thus if to be dispensed are a Cola soda, 7-Up soda and Ginger Ale, then these may be contained in 5 gallon supply cylinders into whose inputs are fed pressurized carbon dioxide drawn from a $CO_2$ cylinder. The pressurized output of the soda cylinders are fed by separate lines to the cooling coils embedded in the cold plate.

In a post-mix system the beverages are not fully constituted but are in syrup form. Thus the supply may take the form of 5 gallon supply cylinders or plastic-lined boxes containing the syrups for the respective sodas to be dispensed. These syrups are intermingled with carbonated water obtained from a carbonator coupled to a pressurized water supply. But whether a pre-mix or a post-mix system is employed, cooling of the beverages takes place in the cold plates through whose cooling coils the beverages are caused to flow.

Of prior art interest is the Pritchett patent No. 4,678,104 (1987), which discloses a cooling system for dispensing beverages. Use is made for this purpose of a tub open at both its top and bottom, adapted to accommodate a cold plate having cooling coils cast therein. The cold plate, which has a block-like form, is covered by ice cubes; hence the beverages passing through these coils are brought to a low temperature.

However, the Pritchett arrangement suffers from a practical drawback; for as the ice cubes melt and water accumulates a barrier is formed between the planar top surface of the cold plate and the ice cubes. Since water at 32° F. has poor thermal conductivity and lower BTU removal than ice, the beverages flowing through the cooling coils are not adequately cooled.

Moreover, in Pritchett, the relationship between the tub and the cold plate is not that all of the ice cubes filling the tub rest on the planar top of the cold plate and make no contact with the side of the plate. This cuts down the rate of heat transfer between the cold ice cubes and the beverages flowing through the cooling coils.

In Pritchett et al., 4,617,807 (1986), the cold plate is again in block-like form and has a planar top covered with ice cubes. But in this arrangement, the cold plate has a hole at its center to drain away liquefied ice. However, because the block has a planar top face, the drain hole does not act to quickly drain all of the liquefied ice, especially if the cold plate is somewhat tilted, as can often be the case in practice. Nor can the drain hole discharge water collected about the vertical sides of the cold plate.

Also of prior art interest is the Lents et al. patent No. 4,423,830 (1984), which shows a block-like cold plate that incorporates in its structure a water drain tube.

SUMMARY OF INVENTION

In view of the foregoing, the main object of this invention is to provide a cold plate for cooling beverages, the plate being installable in the well of a sink in which it is covered by ice cubes, the configuration of the cold plate and the structure of the sink being such that as the ice cubes melt, the resultant water is quickly drained away and does not create a thermal barrier between the ice and the cold plate.

A significant advantage of the invention is that because liquefied ice is quickly drained from the sink and is also prevented from collecting under the cold plate, the sink may be used as a sanitary supply of ice cubes, not only to cool the cold plate, but also to be added as "rocks" to drinks.

More specifically, an object of the invention is to provide a cold plate of the above type having a sloped roof, whereby liquefied ice falling on the roof runs off from the cold plate and is drained from the sink through a drain hole therein. The sloped roof enhances the surface area in contact with the layer of ice particles covering the roof and hence the degree of heat exchange between the ice and the cold plate.

Also an object of this invention is to provide a thermally-insulated sink having a well adapted to so receive a cold plate as to create a gutter between the walls of the well and the walls of the plate, the gutter being occupied by ice cubes filling the well, thereby subjecting the exposed surfaces of the cold plate to the temperature of the ice cubes and bringing about a rapid reduction in the temperature of the beverages flowing through the coils of the cold plate.

Yet another object of this invention is to provide a cold plate and sink assembly in which the cold plate is clamped onto the well of the sink and may be readily installed or dismantled.

Briefly stated, these objects are attained in a cold plate for cooling different beverages drawn from supply cylinders or other sources, the cold plate being formed by a rectangular base over which is a run-off roof defined by sloping end and side sections. Embedded in the cold plate are cooling coils terminating in input and output terminals that project from the underside of the base, the coil inputs being coupled by upstream lines to respective supply cylinders, the coil outputs being coupled by downstream lines to a soda gun to selectively dispense the beverages. The cold plate is received in the well of a thermally-insulated sink having an open bottom bordered by a rectangular ledge. The base of the cold plate is seated on the ledge in spaced relation to the sides of the well to define a gutter in which there is a water drain. The sink is filled with ice cubes that cover the exposed surfaces of the cold plate and are in heat-exchange relationship with the cooling coils to cool the beverages flowing therethrough. As ice cubes melt, the resultant water runs off the roof and is collected in the gutter from which it is drained, thereby avoiding the formation of a water barrier thermally isolating the ice cubes from the cold plate.

BRIEF DESCRIPTION OF DRAWINGS

For a better understanding of the invention as well as other objects and further features thereof, reference is made to the following detailed description to be read in conjunction with the accompanying drawings, wherein:

FIG. 3 is a perspective view of the cold plate and a bottom plate by means of which the cold plate is clamped to a ledge bordering the opening in the bottom of the well;

FIG. 4 is an underside view of the cold plate;

DESCRIPTION OF INVENTION

The Basic Beverage Cooling System

Figure 1:
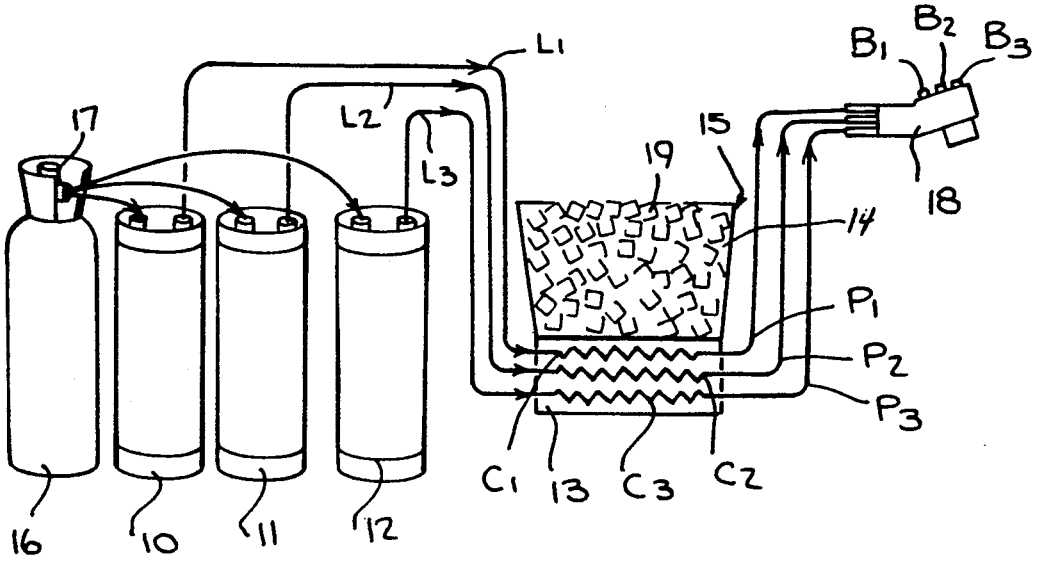
FIG. 1 schematically shows a pre-mix cooling system which includes a cold plate and sink assembly in accordance with the invention.

FIG. 1 schematically illustrates a pre-mix system in which a cold plate installed in the well of a sink functions to cool the beverages to be dispensed. These beverages are contained in three supply cylinders 10, 11 and 12, and by way of example, one is Cola soda, the second is 7 Up and the third, Tonic soda.

The outputs of cylinders 10, 11 and 12 are fed by upstream pipes or lines $L_1$, $L_2$ and $L_3$ to the input terminals of three coils $C_1$, $C_2$ and $C_3$ embedded in a cold plate 13 installed in the well 14 of a sink 15 filled with ice cubes 19. The coils, which are in a spiral or serpentine shape in order to increase their overall length within the confines of the cold plate, are in heat exchange relationship with the ice cubes. As a consequence, heat is transferred from the beverages flowing through these coils, the heat acting to melt the ice cubes.

In order to pressurize the sodas contained in cylinders 10, 11 and 12 so as to force the beverages out of this cylinder pressurized carbon dioxide contained in a $CO_2$ tank 16 is fed by way of a pressure regulator 17 into the inputs of cylinders 10, 11 and 12.

The output terminals of cold plate coils $C_1$, $C_2$ and $C_3$ are coupled through downstream lines or pipes $P_1$, $P_2$ and $P_3$ to a hand-held soda gun 18 having button-controlled valves. Thus when an operator of the gun actuates button $B_1$, Cola soda is discharged from the nozzle of the gun. When button $B_2$ is actuated, then 7 Up is dispensed, Tonic soda being dispensed when button $B_3$ is actuated.

In practice, the system may include more than three beverage supplies; hence if there are six supplies, the cold plate must have six cooling coils, one for each beverage. And the system may be of the post-mix type rather than the pre-mix type illustrated. The concern of the present invention is not the overall system which is generally known, but the novel cold plate and sink assembly included in the system.

The Cold Plate And Sink Assembly

Figure 2:
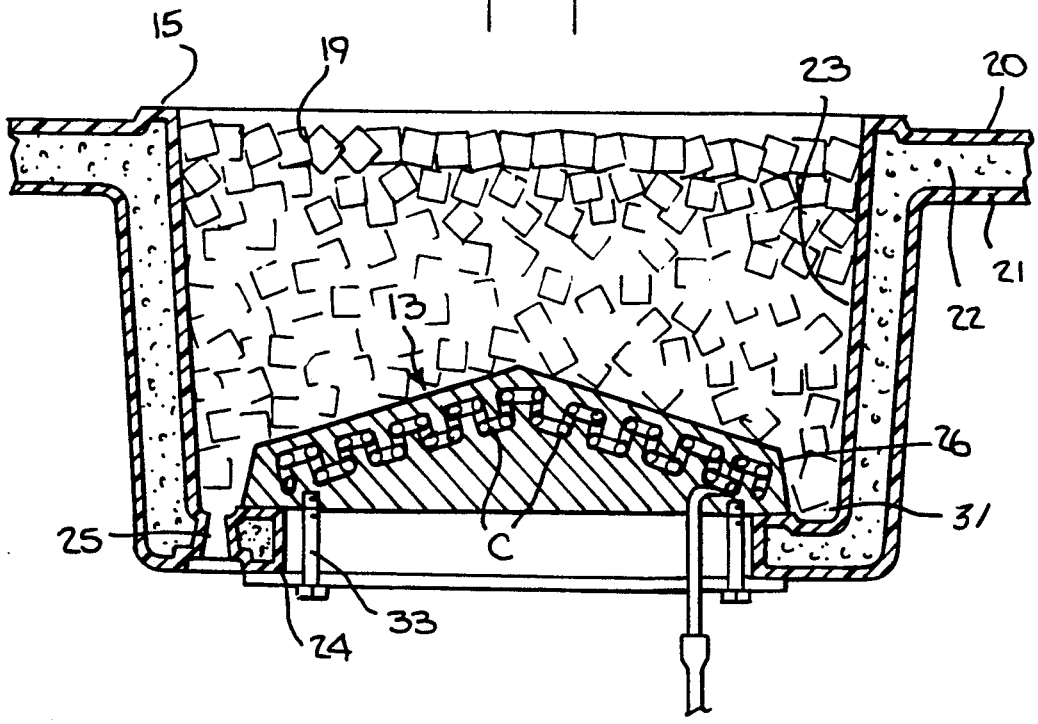
FIG. 2 is a longitudinal section taken through a cold plate installed in the well of a sink to provide an assembly in accordance with the invention.
Figure 5:
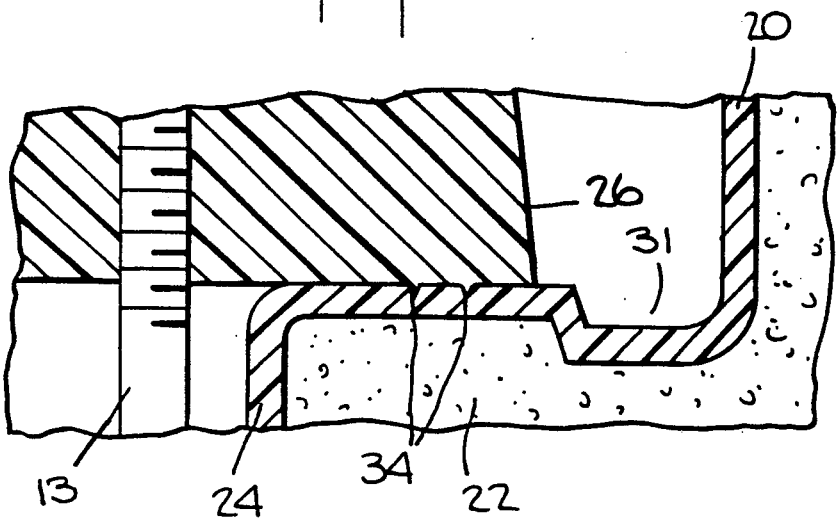
FIG. 5 illustrates the sealing relationship between the base of the cold plate and the ledge of the well.

As shown in FIGS. 2 and 3, sink 15 is in a laminate form in which outer skins 20 and 21 molded of synthetic plastic material, such as polypropylene or polyethylene, sandwich a core 22 formed of thermal insulation material, such a synthetic foam plastic or balsa wood.

Sink 15 is shaped to define a horizontal work surface and a well 23 having vertical sides and an open bottom bordered by a rectangular ledge 24. Formed in this ledge is a water drain 25 adjacent a side wall of the sink.

Cold plate 13 is cast of aluminum or other metal of high thermal conductivity, the plate having a generally rectangular base 26 whose sides are slightly inclined outwardly, over which base is a roll-off roof in a quasi-pyramidical form defined by a pair of truncated triangular side sections 27 and 28 and a pair of triangular end sections 29 and 30. Embedded in cold plate 13 are six cooling coils C having six input terminals $I_1$ to $I_6$ and six output terminals $O_1$ to $O_6$. The terminals are aligned in a row and project from the underside of base 26 of the cold plate. In practice, the coils and their terminals are preferably formed of stainless steel tubing.

Figure 6:
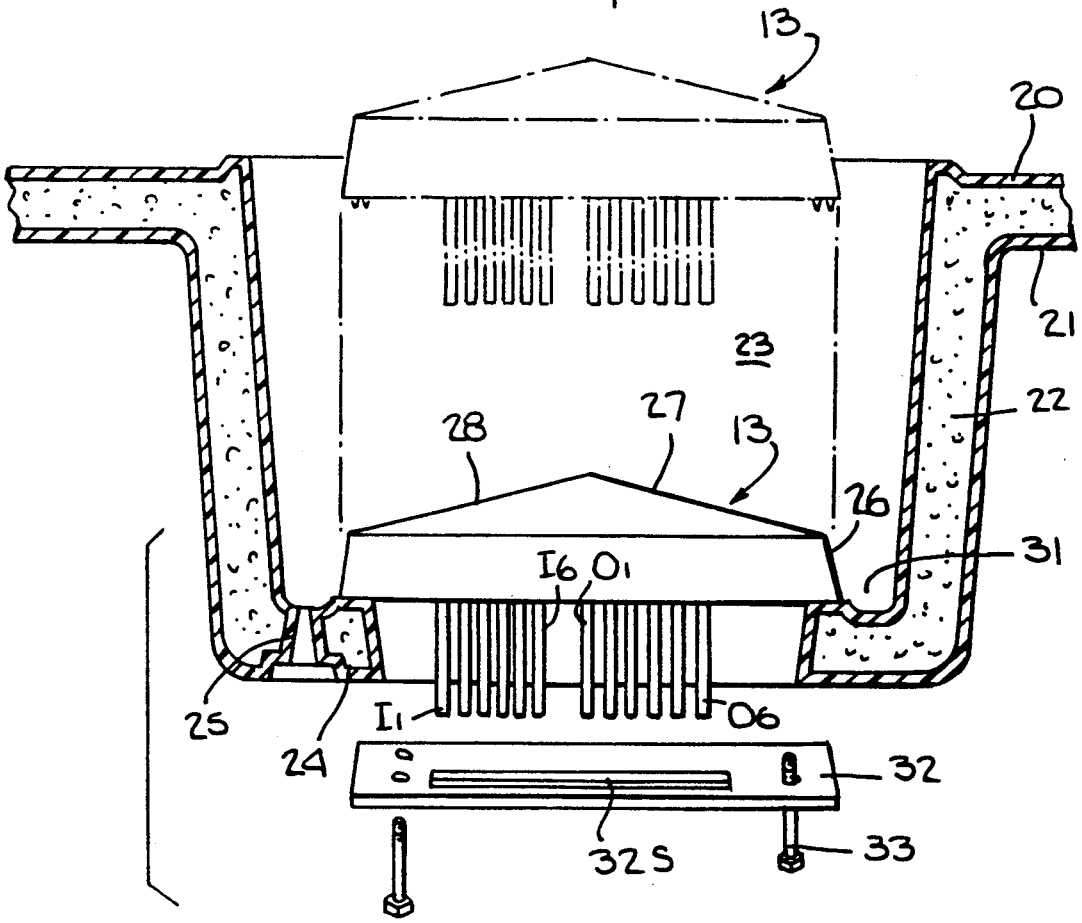
FIG. 6 shows how the cold plate is installed in the well of the sink.

As best seen in FIGS. 3 and 6, base 26 of cold plate 13 rests on ledge 24 bordering the bottom opening of the well. The rectangular dimensions of the cold plate base are somewhat smaller than those of the well 23 in the sink so that the sides of the base are in spaced relation to the sides of the well to define a gutter 31 surrounding the base. The gutter is drained by drain hole 25.

To clamp the cold plate to the ledge of the well, a bottom plate 32 is provided. The bottom plate 32 has about the same rectangular dimensions as that of base 26 of the cold plate, and is attached thereto by bolts 33, the bottom plate lying below ledge 24 and the cold plate being seated on the ledge. Bottom plate 32 is provided with a slot 32S to admit the coil input and output terminals.

In order to prevent water from seeping under the base of the cold plate and stagnating thereunder, sealing ribs 34 in a frame formation are formed on the underside of base 26 of the cold plate. These ribs, when the cold plate is clamped onto ledge 24 of the well press into the plastic outer skin of this ledge to prevent water from seeping under the cooling plate base.

The coil input terminals $I_1$ to $I_6$ are coupled by upstream lines to six beverage supply cylinders, and coil output terminals $O_1$ to $O_6$ are coupled by downstream lines to a six-button soda gun or to a suitable valved mechanism for selectively dispensing the cold beverages.

The sink is filled with ice cubes 29 or ice particles in other shapes, and these cover not only the sloped roof of the cold plate but also lie within gutter 31 where they surround the sides of cold plate base 26; hence all exposed surfaces of the cold plate are in contact with and in heat exchange relationship with ice cubes. In this way, rapid cooling takes place of the beverages flowing in the cooling coils.

However, as heat is transferred from the beverages to the ice cubes and they proceed to melt, the resultant water does not collect but runs down the sloped roof of the cold plate and down the inclined sides of the base into gutter 31 from which the water is quickly drained through drain 25. In this way, no water barrier is formed to thermally isolate the ice cubes from the cold plate.

Since no water is permitted to collect and stagnate in the sink and there is space around the cold plate to allow for cleaning, its sanitary condition may be maintained. Hence the ice cubes which fill the sink can also be used as "rocks" for cold drinks. In practice, the space between back plate 32 and the undersurface of cold plate 13 may have injected therein a synthetic foam plastic material providing thermal insulation and also acting as a sanitary sealant for any bottom openings.

While there has been shown and described a preferred embodiment of a cold plate for cooling beverages in accordance with the invention, it will be appreciated that many changes and modifications may be made therein without, however, departing from the essential spirit thereof.

Thus instead of having six coil circuits embedded in the cold plate, as shown, with their input and output terminals all in a row on one side of the undersurface of the cold plate, the cold plate may be cast with one set of three coil circuits on one side of the roof and a second set set of three coil circuits on the other side of the roof, with the input and output terminals of one set being in a row on one side of the cold plate undersurface and the input and output terminals of the other set being in a row on the other side.

While the surface of the sloped roof is shown as being smooth, in practice all of the sections of the roof are sanded to create minute downflow gutters in the plane of run-off to direct the water down the roof in the shortest possible path.

We claim:

1. A cold plate assembly for cooling different beverages drawn from supply containers, the cold plate being installable in the well of a sink having a water drain at its bottom, said well having side walls and an open bottom bordered by a rectangular ledge, said water drain being formed on the ledge, said assembly comprising:

(a) a cold plate having a generally rectangular base above which is a run-off sloped roof, said plate being seated on the ledge to define a gutter surrounding the cold plate and leading to the drain in a space between the base of the plate and the side walls of the well; and (b) cooling coils embedded in said cold plate, each coil having an input terminal and an output terminal projecting below the base through the bottom of the sink, the coil input terminals being connectable by upstream lines to respective beverage supply containers, the coil output terminals being connectable by downstream lines to a beverage dispenser, the coil terminals extending below the base of the cold plate into the open bottom of the well, said sink being fillable with ice particles which are in heat exchange relationship with exposed surfaces of the cold plate and the coils embedded therein whereby heat transferred from the beverages flowing through the coils to the ice cubes causes melting thereof to produce water which runs off the sloped roof of the cold plate and is drained into the gutter from which said water is drained.

2. An assembly as set forth in claim 1, wherein said cold plate is an aluminum casting.

3. An assembly as set forth in claim 2, wherein said coils and their terminals are formed of stainless steel tubing.

4. In an assembly as set forth in claim 1, wherein said roof is in quasi-pyrimidical form constituted by a pair of truncated, triangular side sections and a pair of triangular end sections.

5. An assembly as set forth in claim 1, wherein said sink is molded of a laminate formed by outer skins of thermoplastic synthetic plastic material between which is sandwiched a core of thermal insulation material.

6. An assembly as set forth in claim 1, wherein said cold plate base is provided at its underside with sealing ribs which engage the surface of the ledge to prevent the seepage of water under the base.

7. An assembly as set forth in claim 1, further including a bottom plate which is placed under the ledge and is bolted to the base of the cold plate which is seated on the ledge to clamp the cold plate to the ledge.

8. An assembly as set forth in claim 7, wherein said coil input and output terminals are aligned in a row and said bottom plate is provided with a slot through which the terminals project.

* * * * *